US009672980B2

(12) United States Patent
Peng et al.

(10) Patent No.: US 9,672,980 B2
(45) Date of Patent: Jun. 6, 2017

(54) R-T-B-M-C SINTERED MAGNET AND PRODUCTION METHOD AND AN APPARATUS FOR MANUFACTURING THE R-T-B-M-C SINTERED MAGNET

(71) Applicants: Zhongjie Peng, Yantai (CN); Xiaotong Liu, Yantai (CN); Shengli Cui, Yantai (CN); Kaihong Ding, Yantai (CN)

(72) Inventors: Zhongjie Peng, Yantai (CN); Xiaotong Liu, Yantai (CN); Shengli Cui, Yantai (CN); Kaihong Ding, Yantai (CN)

(73) Assignee: YANTAI SHOUGANG MAGNETIC MATERIALS INC., Yantai (CN)

( * ) Notice: Subject to any disclaimer, the term of this patent is extended or adjusted under 35 U.S.C. 154(b) by 253 days.

(21) Appl. No.: 14/167,041

(22) Filed: Jan. 29, 2014

(65) Prior Publication Data

US 2014/0210580 A1 Jul. 31, 2014

(30) Foreign Application Priority Data

Jan. 29, 2013 (CN) ..... 2013 1 0033415

(51) Int. Cl.
*H01F 41/02* (2006.01)
*H01F 1/058* (2006.01)
(Continued)

(52) U.S. Cl.
CPC ..... *H01F 41/0266* (2013.01); *B22F 3/02* (2013.01); *C22C 33/0278* (2013.01);
(Continued)

(58) Field of Classification Search
CPC .... H01F 1/0577; H01F 41/0266; B22F 3/004; B22F 3/02
(Continued)

(56) References Cited

U.S. PATENT DOCUMENTS 5,527,504 A 6/1996 Kishimoto et al.
6,344,168 B1 2/2002 Kuniyoshi
(Continued)

FOREIGN PATENT DOCUMENTS

EP 1408518 A2 4/2004
EP 2187410 A1 5/2005
(Continued)

OTHER PUBLICATIONS

Decision to Grant a European Patent Pursuant to Article 97(1) EPC; 91 Pages, May 12, 2016.

*Primary Examiner* — Weiping Zhu
(74) *Attorney, Agent, or Firm* — William H. Honaker; Dickinson Wright PLLC

(57) ABSTRACT

The present invention discloses an R-T-B-M-C sintered magnet and a method for manufacturing the R-T-B-M-C sintered magnet from an R-T-B-M-C alloy powder including the lubricant. The present invention also discloses an apparatus for manufacturing the R-T-B-M-C sintered magnet from the R-T-B-M-C alloy powder including the lubricant. The apparatus includes an alloy powder feeding mechanism for distributing the R-T-B-M-C alloy powder including the lubricant, a filling mechanism including a mold for receiving the R-T-B-M-C alloy powder including the lubricant, a press mechanism for compressing the R-T-B-M-C alloy powder including the lubricant and a stacking mechanism for storing the mold including the R-T-B-M-C alloy powder including the lubricant.

4 Claims, 2 Drawing Sheets

(51) Int. Cl.

| | |
|---|---|
| ***H01F 7/02*** | (2006.01) |
| ***C22C 38/00*** | (2006.01) |
| ***C22C 38/02*** | (2006.01) |
| ***C22C 38/06*** | (2006.01) |
| ***C22C 38/10*** | (2006.01) |
| ***C22C 38/16*** | (2006.01) |
| ***B22F 3/02*** | (2006.01) |
| ***C22C 33/02*** | (2006.01) |
| *H01F 1/057* | (2006.01) |

(52) U.S. Cl.
CPC ..... *C22C 38/005* (2013.01); *C22C 38/02* (2013.01); *C22C 38/06* (2013.01); *C22C 38/10* (2013.01); *C22C 38/16* (2013.01); *H01F 1/058* (2013.01); *H01F 7/02* (2013.01); *H01F 41/0273* (2013.01); *B22F 2003/023* (2013.01); *B22F 2998/10* (2013.01); *B22F 2999/00* (2013.01); *C22C 2202/02* (2013.01); *H01F 1/0577* (2013.01)

(58) Field of Classification Search
USPC ..... 148/101
See application file for complete search history.

(56) References Cited

U.S. PATENT DOCUMENTS

| | | | | |
|---|---|---|---|---|
| 6,361,738 | B1 | 3/2002 | Kaneko et al. | |
| 6,482,349 | B1 | 11/2002 | Kohara et al. | |
| 6,635,120 | B2 | 10/2003 | Tokoro et al. | |
| 6,878,217 | B2 | 4/2005 | Kikugawa et al. | |
| 7,138,017 | B2 | 11/2006 | Kaneko et al. | |
| 7,156,928 | B2 | 1/2007 | Hamada et al. | |
| 2002/0017338 | A1* | 2/2002 | Li | B82Y 25/00 148/101 |
| 2012/0176212 | A1* | 7/2012 | Sagawa | B22F 3/005 335/302 |

FOREIGN PATENT DOCUMENTS

| | | | |
|---|---|---|---|
| EP | 2472535 | A1 | 7/2012 |
| JP | S61119009 | A | 6/1986 |
| JP | H0757914 | A | 3/1995 |
| JP | H07153612 | A | 6/1995 |
| JP | 2006019521 | A | 1/2006 |
| JP | 2006219723 | A | 8/2006 |
| JP | 2009260338 | A | 11/2009 |
| WO | 2011024936 | A1 | 3/2011 |
| WO | 2011125262 | A1 | 10/2011 |

* cited by examiner

R-T-B-M-C SINTERED MAGNET AND PRODUCTION METHOD AND AN APPARATUS FOR MANUFACTURING THE R-T-B-M-C SINTERED MAGNET

CROSS REFERENCE TO RELATED APPLICATION

This application claims the benefit of a Chinese Patent Application having a Serial number of CN 201310033415.4, published as CN 103093921A and filed on Jan. 29, 2013.

BACKGROUND OF THE INVENTION

1. Field of the Invention

The present invention relates generally to a R-T-B-M-C sintered magnet.

2. Description of the Prior Art

Since the invention of the sintered Nd—Fe—B permanent magnet by Mr. Sagawa and others in 1983, its field of application has been expanding continuously. Currently, the field of application includes initial medical magnetic resonance imaging (MRI), hard disk drives voice coil motor (VCM), CD Pickup Mechanism, medical and information technology. The field of application is also gradually expanding to include energy conservation and environmental protection fields such as new energy vehicles, generators, wind generators, air conditioning and refrigerator compressors.

Due to the increasing use of the sintered Nd—Fe—B permanent magnetic materials, rare earth material resources become scarce. Accordingly, there is an increasing need for improvements in the utilization of the rare earth materials. The traditional processing method of the rare earth materials includes using a steel molding process, suppressing the rare earth materials in a first direction and orienting the rare earth materials by applying a magnetic field that is perpendicular to the first direction to produce a compact. After suppressing the rare earth materials, the compact is subjected to an isostatic pressing process. Next, the compact is sintered and subjected to a heat treatment. Using the traditional processing method, it is very difficult to manufacture a compact having small dimensions from the rare earth materials due to mold size and other limitations. For example, using the traditional processing method, it is especially difficult to manufacture a compact from the rare earth materials having an orientation direction larger than 20 mm. With regard to manufacturing permanent magnets from the rare earth materials having a thin orientation direction, additional slicing and grinding are needed which will result in a loss of the rare earth materials. For example, in order to make small permanent magnets having a thickness of 3 mm, slicing process alone will result in a 10% loss in rare earth materials.

In order to improve the utilization of the rare earth magnetic materials, a parallel magnetic suppression process is developed. Using the parallel magnetic suppression process, orientation of the magnetic field and suppression of the rare earth magnetic materials are applied in directions parallel to one another. Accordingly, the permanent magnets can be formed without isostatic pressing and can be directly sintered and subjected to the heat treatment. Because the orientation of the magnetic field and suppression of the rare earth magnetic materials are applied in a direction parallel to one another, thin magnets can be directly formed. After directly forming the thin magnets, the thin magnets can be directly sintered and subjected to a heat treatment. By using the parallel magnetic suppression process, a higher utilization of the rare earth magnetic materials can be achieved because the permanent magnets can be manufactured and grinded without the slicing process. However, using the parallel magnetic suppression process can have a detrimental effect on the physical properties of the permanent magnets. For example, the parallel magnetic suppression process can affect the orientation degree of the permanent magnet, decrease magnetic remanence of the permanent magnet by 0.06-0.07 T, and reduce the magnetic energy of the permanent magnet by 10%.

Another method developed to improve the utilization of the rare earth magnetic materials is a non-pressure molding process. The first step of the non-pressure molding process is filling a mold with magnetic powders and orienting the magnetic powders in the mold by subjecting the magnetic powders to a magnetic field. After orienting the magnetic powders, the magnetic powders are sintered and subjected to a heat treatment. The orienting process is performed without applying pressure to the magnetic powders in the mold. In addition, heat can be introduced to the magnetic powders either before and/or after the orientation process. By adding heat to the magnetic powders, the coercivity of the magnetic powders is lowered, and the degree of orientation of the magnetic powders is increased. After the orienting process, the magnetic powders in the mold are sintered and subjected to the heat treatment. By using the non-pressure molding process, a higher utilization of the rare earth magnetic materials can be achieved because the permanent magnets can be manufactured and grinded without the slicing process.

There are also drawbacks associated with using the non-pressure molding process which will affect the physical properties of the permanent magnetic. The first drawback associated with the non-pressure molding process is that there is a decrease in the density of the magnetic powders. Since pressure is not applied to the magnetic powders during the orientation process, there is a repulsion force between the individual magnetic powder particles in the magnetic powders which lowers the density of the powder and the density of a sintered block obtained from the sintered process. The second drawback associated with the non-pressure molding process is that the magnetic powders are subjected to oxidation. Since the individual magnetic powder particles have a small particle size and heat is applied to the magnetic powders prior to and after the orientation process, in the presence of oxygen, the magnetic powders are prone to oxidation.

SUMMARY OF THE INVENTION

The present invention provides a method to overcome the drawbacks and technical difficulties mentioned above and provide an R-T-B-M-C of sintered magnets.

The present invention provides a solution to the existing problems of orienting and oxidation in the non-pressure molding process.

The present invention provides for an R-T-B-M-C sintered magnet made from an R-T-B-M-C alloy powder wherein R is at least one element selected from rare earth metal elements including Yttrium and Scandium. R is present in an amount of 25 wt. %≤R≤40 wt. %. T is Iron or a mixture of Iron and Cobalt. T is present in an amount of 60 wt. %≤T≤74 wt. %. M is at least one element selected from Ti, Ni, Nb, Al, V, Mn, Sn, Ca, Mg, Pb, Sb, Zn, Si, Zr, Cr, Cu, Ga, Mo, W and Ta. M is present in an amount of 0 wt. %≤M≤2 wt. %. B is Boron and present in an amount of 0.8 wt. %≤B≤1.2 wt. %. C is Carbon and present in an amount of 0.03 wt. %≤C≤0.15 wt. %. The R-T-B-M-C alloy powder also includes a lubricant being present in an amount of between 0.05 wt. % and 2.0 wt. %.

The present invention provides for a method to prepare an R-T-B-M-C sintered rare earth magnet from an R-T-B-M-C alloy powder in a mold. The method includes a first step of mixing the R-T-B-M-C alloy powder having a predetermined particle size with a lubricant under an inert gas environment to produce an R-T-B-M-C alloy powder including the lubricant. The second step of the method is filling the mold with the R-T-B-M-C alloy powder including the lubricant to a filling density under the inert gas environment. The third step of the method is compressing the R-T-B-M-C alloy powder including the lubricant in the mold under a predetermined pressure between 0.2 MPa and 2 MPa. The fourth step of the method is orienting the R-T-B-M-C alloy powder including the lubricant by applying a magnetic field to the R-T-B-M-C alloy powder including the lubricant under the inert gas environment to form a compact. The fifth step of the method is sintering the compact. The sixth step of the method is subjecting the sintered compact to a heat treatment.

The present invention provides an apparatus for preparing an R-T-B-M-C sintered magnet from an R-T-B-M-C alloy powder including a lubricant in a warehouse and under an inert gas environment. The apparatus includes a support. An alloy powder feeding mechanism disposed on the support for distributing the R-T-B-M-C alloy powder including the lubricant. A filling mechanism including a mold is disposed adjacent to the alloy powder feeding mechanism for accepting the R-T-B-M-C alloy powder including the lubricant from the powder feeding mechanism. The filling mechanism further includes a vibration device disposed below the mold. A press mechanism is dispose adjacent to and spaced apart from the filling mechanism. The press mechanism includes a pair of punches having an upper punch and a lower punch. Each of the punches includes an air cylinder attached thereto for actuating the upper punch and the lower punch between a first position and a second position. The press mechanism further includes an orienting device having a plurality of coils for providing a magnetic field to magnetize the R-T-B-M-C alloy powder including the lubricant in the mold. A stacking device is disposed adjacent to the pressing mechanism for storing the mold after compressing and magnetizing the R-T-B-M-C alloy powder including the lubricant in the pressing mechanism.

Advantages of the Invention

The present invention allows for a method to manufacture an R-T-B-M-C sintered magnet from an R-T-B-M-C alloy powder including a lubricant that prevents the filling density of the R-T-B-M-C alloy powder including the lubricant in the mold from decreasing due to the repulsion force. In addition, the present invention allows for an R-T-B-M-C sintered magnet having improved magnetic properties. Furthermore, the present invention allows for a method to manufacture the R-T-B-M-C sintered magnet that saves energy, improves production efficiency, and avoids oxidation the production process and other negative phenomena.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
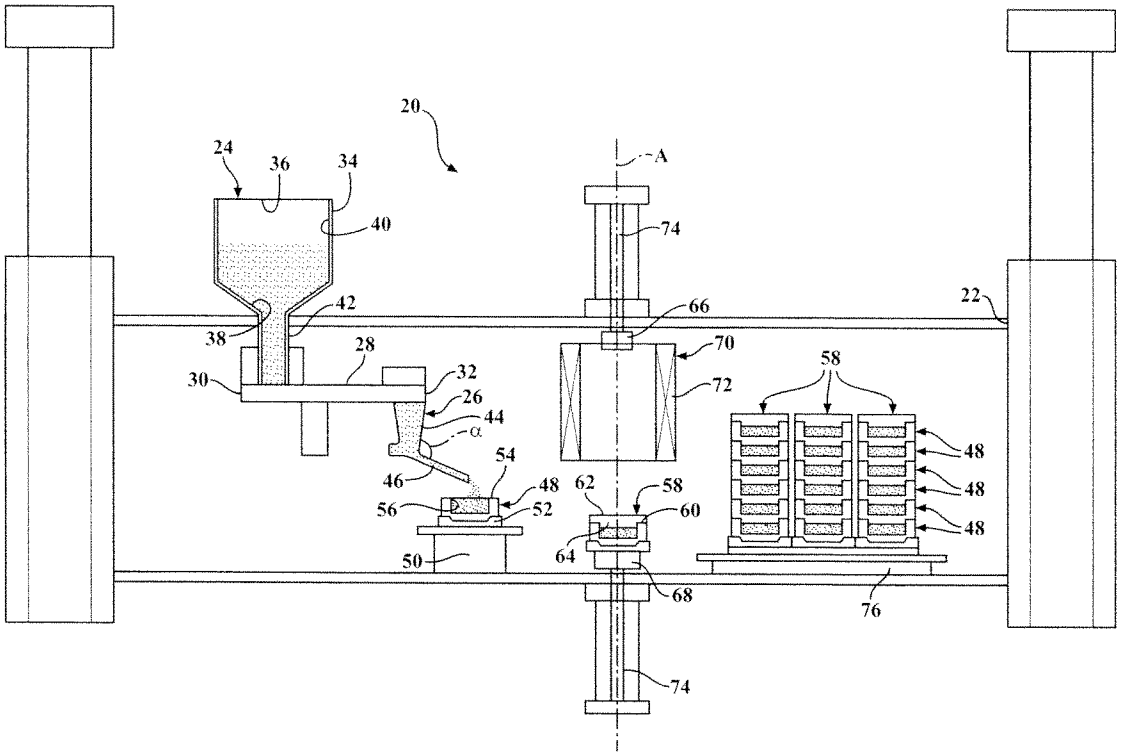
FIG. 1 is a schematic view of the apparatus used for preparing the R-T-B-M-C sintered rare earth magnet.
Figure 2:
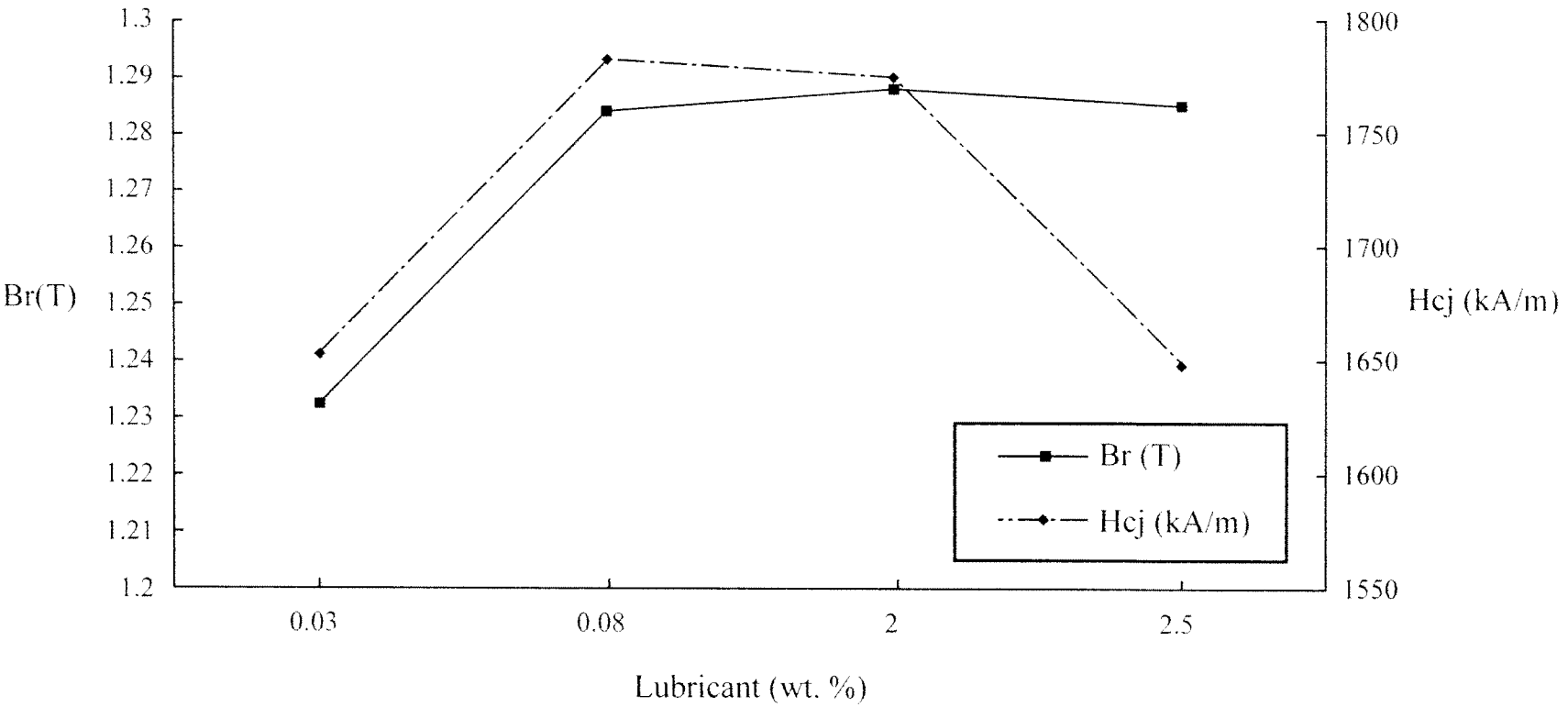
FIG. 2 is a graphical comparison of the physical properties of the sintered blocks 1, 2, 3 and 4 set forth in Example 2.

Referring to the Figures, wherein like numerals indicate corresponding parts throughout the several views, an apparatus for preparing an R-T-B-M-C sintered rare earth magnet from an R-T-B-M-C alloy powder including a lubricant is generally shown in FIG. 1.

The apparatus 20, as generally shown, operates in a warehouse 22 and under an inert gas environment. The apparatus 20 includes a support Not Shown disposed in the warehouse 22. The apparatus 20 further includes an alloy powder feeding mechanism 24, 26, 28 disposed on the support Not Shown. The alloy powder feeding mechanism 24, 26, 28 includes a container 24 for storing the R-T-B-M-C alloy powder including the lubricant, a feeder 26 for distributing the R-T-B-M-C alloy powder including the lubricant and a powder mover 28 extending between a first end 30 and a second end 32. The first end 30 of the powder mover 28 is disposed in communication with the container 24. The second end 32 of the powder mover 28 is disposed in communication with the feeder 26 for allowing the powder mover 28 to transport the R-T-B-M-C alloy powder including the lubricant from the container 24 to the feeder 26.

The container 24, as generally indicated, includes a wall 34 having a pentagonal shape in cross section extending between and an opening 36 and an exit 38. The wall 34 defines a main chamber 40 extending between the wall 34 and the opening 36 and the exit 38 for storing the R-T-B-M-C alloy powder including the lubricant. The container 24 further includes a neck 42 extending outwardly from the exit 38 of the container 24 and disposed in communication with the powder mover 28 in a perpendicular relationship at the first end 30 of the powder mover 28 for transferring the R-T-B-M-C alloy powder including the lubricant from the main chamber 40 of the container 24 to the powder mover 28.

The feeder 26, as generally indicated, includes a receiving portion 44 having a trapezoidal shape in cross section disposed in communication with the second end 32 of the powder mover 28 in a perpendicular relationship for accepting the R-T-B-M-C alloy powder including the lubricant from the container 24. The feeder 26 also includes a chute 46 having a tubular shape extending outwardly from said receiving portion 44 at an obtuse angle $\alpha$ relative to the receiving portion 44 to a discharging end for distributing the R-T-B-M-C alloy powder including the lubricant from the feeder 26.

A filling mechanism 48, 50, as generally indicated, is disposed adjacent to and spaced apart from the discharging end of the feeder 26 for accepting the R-T-B-M-C alloy powder including the lubricant from the discharging end of the feeder 26. The filling mechanism 48, 50 includes a mold 48. The mold 48 has a U-shaped cross section including a base 52 and a plurality of sides 54 extending outwardly from the base 52 in a perpendicular relationship to define a cavity 56 extending between the base 52 and the sides 54 for containing the R-T-B-M-C alloy powder including the lubricant. The filling mechanism 48, 50 further includes a vibration device 50 disposed below the base 52 of the mold 48 for supporting the mold 48 and oscillating the mold 48 containing the R-T-B-M-C alloy powder including the lubricant to allow the R-T-B-M-C alloy powder including the lubricant to reach a filling density of between 2.8 g/cm$^3$ and 3.2 g/cm$^3$.

A cover 58 having a T-shaped cross section is disposed on the mold 48 engaging the sides 54 of the mold 48 for closing the mold 48. The cover 58 defines an inner surface 60 for engaging the sides 54 of the mold 48 and an outer surface 62. A projection 64 extends outwardly and perpendicularly from the inner surface 60. The projection 64 extends toward the base 52 in the cavity 56 and abuts the sides 54 of the mold 48 to engage the R-T-B-M-C alloy powder including the lubricant disposed in the mold 48.

A press mechanism 66, 68, 70, as generally indicated, is dispose adjacent to and spaced apart from the filling mechanism 48, 50 for compressing the R-T-B-M-C alloy powder including the lubricant in the mold 48 and subjecting the R-T-B-M-C alloy powder including the lubricant in the mold 48 to a magnetic field. The press mechanism 66, 68, 70 includes a pair of punches 66, 68 having an upper punch 66 and a lower punch 68 disposed axially aligned and spaced apart with one another along a center axis A for compressing the R-T-B-M-C alloy powder including the lubricant in the mold 48.

The press mechanism 66, 68, 70 further includes an orienting device 70 of tubular shape disposed on the center axis A between the upper punch 66 and the lower punch 68 for magnetizing the R-T-B-M-C alloy powder including the lubricant. The orienting device 70 includes a plurality of coils 72 extending annularly about the center axis A defining an orienting chamber extending along the center axis A for providing a magnetic field to magnetize the R-T-B-M-C alloy powder including the lubricant in the mold 48. To provide the magnetic field, a pulsed Direct Current (DC) is sent through the coils 72 generating a magnetic field having a magnetic field strength of at least 3.5 T.

The upper punch 66 defines an upper punch 66 surface for engaging the outer surface 62 of the cover 58. The lower punch 68 defines a lower punch 68 surface for engaging and supporting the base 52 of the mold 48. Each of the punches 66, 68 includes an air cylinder 74 attached thereto for actuating the upper punch 66 and the lower punch 68 between a first position and a second position. In the first position, the upper punch 66 surface is spaced apart from the outer surface 62 of the cover 58 of the mold 48. In the second position, the upper punch 66 engages the outer surface 62 of the cover 58 of the mold 48 to sandwiching the mold 48 between the upper punch 66 and the lower punch 68 for compressing the R-T-B-M-C alloy powder including the lubricant in the mold 48. In the second position, the mold 48 sandwiched between the punches 66, 68 is also disposed in the orienting chamber for magnetizing the R-T-B-M-C alloy powder including the lubricant.

A stacking device 76 is disposed adjacent to the pressing mechanism for storing the mold 48 after compressing and magnetizing the R-T-B-M-C alloy powder including the lubricant in the pressing mechanism.

The present invention also provides for a method of preparing an R-T-B-M-C sintered magnet from an R-T-B-M-C alloy powder in a mold 48. The method includes a first step of mixing the R-T-B-M-C alloy powder having a predetermined particle size with a lubricant under an inert gas environment to produce an R-T-B-M-C alloy powder including the lubricant. The lubricant is at least one or a mixture selected from a salt of stearic acid, oleic acid, boric acid, methyl acetate and caprylic methyl ester. The predetermined particle size of the R-T-B-M-C alloy powder has an average particle size of less than 8 nm. The next step of the method is filling the mold 48 with a predetermined amount of the R-T-B-M-C alloy powder including the lubricant to a filling density of between 2.8 g/cm$^3$ and 3.8 g/cm$^3$ under the inert gas environment. The third step of the method is compressing the R-T-B-M-C alloy powder including the lubricant in the mold 48 under a predetermined pressure of between 0.2 MPa and 2 MPa. The fourth step of the method is orienting the R-T-B-M-C alloy powder including the lubricant in the mold 48 by applying a magnetic field to the R-T-B-M-C alloy powder including the lubricant to produce a compact. The magnetic field applied is a pulsed Direct Current (DC) magnetic field having a magnetic field strength of at least 3.5 T. The compact is then sintered and the sintered compact is subjected to a heat treatment.

The present invention further provides for an R-T-B-M-C sintered magnet made from an R-T-B-M-C alloy powder. The R-T-B-M-C alloy powder includes R being at least one element selected from rare earth metal elements including Yttrium (Y) and Scandium (Sc). R is present in an amount of between 25 wt. % and 40 wt. %. T is Iron (Fe) or a mixture of Fe and Cobalt (Co). T is present in an amount of between 60 wt. % and 74 wt. %. M is at least one element selected from Titanium (Ti), Nickel (Ni), Niobium (Nb), Aluminum (Al), Vanadium (V), Manganese (Mn), Tin (Sn), Calcium (Ca), Magnesium (Mg), Lead (Pb), Antimony (Sb), Zn (Zinc), Silicon (Si), Zirconium (Zr), Chromium (Cr), Copper (Cu), Gallium (Ga), Molybdenum (Mb), Tungsten (W) and Tantalum (Ta). M is present in an amount of between 0 wt. % and 2 wt. %. B is Boron and present in an amount of between 0.8 wt. % and 1.2 wt. %. C is Carbon and present in an amount of between 0.03 wt. % and 0.15 wt. %. The R-T-B-M-C alloy powder further includes a lubricant being present in an amount between 0.05 wt. % and 2.0 wt. %. The lubricant is at least one or a mixture selected from a salt of stearic acid (e.g. zinc stearate), oleic acid, boric acid, methyl acetate, and caprylic acid methyl ester.

In operation, the R-T-B-M-C alloy powder including the lubricant is first disposed in the main chamber 40 of the container 24. The powder mover 28 is used to transport the R-T-B-M-C alloy powder including the lubricant from the container 24 to the feeder 26. Through the chute 46 of the feeder 26, the R-T-B-M-C alloy powder including the lubricant is deposited in the cavity 56 of the mold 48. A carrier is used move the mold 48 filled with the R-T-B-M-C alloy powder including the lubricant to the vibration device 50 for oscillating the mold 48 to allow the R-T-B-M-C alloy powder including the lubricant to reach the filling density of between 2.8 g/cm$^3$ and 3.8 g/cm$^3$. Alternatively, instead of using the carrier, the mold 48 can be placed directly disposed on the vibration device 50 for receiving the R-T-B-M-C alloy powder including the lubricant from the chute 46 of the feeder 26. The carrier can be any device or apparatus 20 used to move an object from one place to another, e.g. a robotic arm or a conveyor belt.

Next, the cover 58 is placed on the mold 48 wherein the projection 64 of the cover 58 engages the R-T-B-M-C alloy powder including the lubricant. The next step of the process is moving the mold 48 including the cover 58 from the vibration device 50 to the press mechanism 66, 68, 70 wherein the base 52 of the mold 48 is supported by the lower punch 68 surface of the lower punch 68 of the press mechanism 66, 68, 70. The upper punch 66 and the lower punch 68 is then actuated from the first position to the second position allowing the upper punch 66 to engage the cover 58 of the mold 48 to compress the R-T-B-M-C alloy powder including the lubricant without significantly affecting the filling density of the R-T-B-M-C alloy powder including the lubricant in the mold 48. Next, the mold 48 is moved by the lower punch 68 into the orienting chamber of the orienting device 70 to subject the R-T-B-M-C alloy powder including the lubricant to the magnetic field generated by the orienting device 70 to magnetize the R-T-B-M-C alloy powder including the lubricant. After magnetizing the R-T-B-M-C alloy powder including the lubricant in the mold 48, the mold 48 is stored adjacent to the orienting device 70 by using the stacking device 76 in preparation for a sintering process.

Example 1

A R-T-B-M-C alloy powder including a lubricant is prepared by first melting a raw material of the a R-T-B-M-C allow powder wherein R is at least one element selected from rare earth elements including Yttrium and Scandium, T is Iron or a mixture of Iron and Cobalt, M is at least one element selected from Ti, Ni, Nb, Al, V, Mn, Sn, Ca, Mg, Pb, Sb, Zn, Si, Zr, Cr, Cu, Ga, Mo, W and Ta, B is Boron and C is Carbon. The next step of the method is forming an alloy sheet by subjecting the molten raw material to a strip casting process. The alloy sheet is then subjected to a decrepitation process under hydrogen. After the decrepitation process, hydrogen is removed and the R-T-B-M-C alloy powder is pulverized in a jet mill filled with a predetermined amount of oxygen to produce the R-T-B-M-C alloy powder having an average particle size of $X_{50}$=5.0 μm. Next, the R-T-B-M-C alloy powder is stored in an inert gas environment. To improve orientation characteristics of the R-T-B-M-C alloy powder, the lubricant is added to the R-T-B-M-C alloy powder. Specifically, 0.05 wt. % of zinc stearate is mixed with the R-T-B-M-C alloy powder for 5 hours to produce the R-T-B-M-C alloy powder including the lubricant.

The apparatus 20 described above and showed in FIG. 1 is used in a process set forth in this example to produce a plurality of R-T-B-M-C sintered blocks from the R-T-B-M-C alloy powder. The first step of the process is filling the container 24 of the alloy feeding mechanism with the R-T-B-M-C alloy powder including the lubricant. Next, the R-T-B-M-C alloy powder including the lubricant is distributed from the feeder 26 to the mold 48 disposed on the vibration device 50. The vibration device 50 oscillates the mold 48 to allow the R-T-B-M-C alloy powder including the lubricant in the mold 48 to reach a predetermined density of 3.2 g/cm$^3$. The R-T-B-M-C alloy powder including the lubricant in the mold 48 is then compressed at a predetermined pressure by the pressing mechanism and subjected to an orientating process under a magnetic field having a magnetic field strength of 6 T produced by the orienting device 70 to magnetize the R-T-B-M-C alloy powder including the lubricant. After magnetizing the R-T-B-M-C alloy powder including the lubricant, filling density after magnetization of the R-T-B-M-C alloy powder including the lubricant is calculated. Next, the R-T-B-M-C alloy powder including the lubricant is sintered at a temperature of 1060° C. for a period of 5 hours and heat treated at a temperature of 500° C. for a period of 3 hours to produce a sintered block. R-T-B-M-C sintered blocks 1 through 4 are made using the method described above. Compositions of the sintered blocks 1 through 4 are shown below in Table 1.

TABLE 1

Compositions of the R-T-B-M-C Sintered Blocks (wt. %)

| | Nd | Pr | Dy | Co | B | Al | Cu | Ga | C | Fe |
|---|---|---|---|---|---|---|---|---|---|---|
| Sintered Block Composition 1 | 21.60 | 6.24 | 4.46 | 0.89 | 0.95 | 0.13 | 0.10 | 0.10 | 0.08 | Bal |
| Sintered Block Composition 2 | 21.58 | 6.25 | 4.48 | 0.88 | 0.96 | 0.11 | 0.10 | 0.09 | 0.08 | Bal |
| Sintered Block Composition 3 | 21.59 | 6.28 | 4.49 | 0.87 | 0.95 | 0.13 | 0.09 | 0.08 | 0.07 | Bal |
| Sintered Block Composition 4 | 21.62 | 6.29 | 4.48 | 0.89 | 0.96 | 0.13 | 0.10 | 0.09 | 0.08 | Bal |

The sintered blocks 1 through 4 were made from the R-T-B-M-C alloy powders including the lubricant. When compressing, the R-T-B-M-C alloy powders including the lubricant were subjected to different predetermined pressures. Physical properties of sintered blocks 1 through 4 are shown below in Table 2.

TABLE 2

Physical Properties of the Sintered Blocks 1 through 4 Listed in Table 1.

| | Predetermined Pressure (Compression) MPa | Filling density after magnetize (g/cm$^3$) | Density after sintering (g/cm$^3$) | Br (T) | Hcb (kA/m) | Hcj (kA/m) | (BH)m (kJ/m$^3$) | Hk/Hcj |
|---|---|---|---|---|---|---|---|---|
| Sintered Block Composition 1 | 0.2 | 3.19 | 7.56 | 1.279 | 978 | 1725 | 302 | 0.92 |
| Sintered Block Composition 2 | 2 | 3.2 | 7.58 | 1.281 | 983 | 1731 | 309 | 0.94 |
| Sintered Block Composition 3 | 0.05 | 2.63 | 7.45 | 1.248 | 949 | 1691 | 286 | 0.89 |
| Sintered Block Composition 4 | 3 | 3.2 | 7.58 | 1.242 | 940 | 1678 | 279 | 0.86 |

As indicated in Table 2 above, when the predetermined pressure is between 0.2 MPa and 2 MPa, the filling density of the R-T-B-M-C alloy powders including the lubricant in the mold 48 does not change after being magnetized by the orienting device 70. When the predetermined pressure is less than 0.2 MPa, there is a significant decrease in the filling density of the R-T-B-M-C alloy powders including the lubricant in the mold 48 after being magnetized by the orienting device 70. This phenomenon is caused by a repulsion effect of the R-T-B-M-C alloy powders including the lubricant after being magnetized by the orienting device 70. The repulsion effect creates small cracks in the R-T-B-M-C alloy powders including the lubricant thereby reducing the filling density of the R-T-B-M-C alloy powders including the lubricant and the density of the sintered block. As indicated by the Sintered Block Composition 4 in Table 2, when the predetermined pressure is more than 3 MPa, the physical properties of the Sintered Block deteriorates.

Example 2

The R-T-B-M-C alloy powder including the lubricant used in this example is prepared in the same manner as the R-T-B-M-C alloy powder including the lubricant set forth in Example 1. In this example, Boric acid is used as the lubricant. Specifically, boric acid is mixed with the R-T-B-M-C alloy powder at various amounts for hours to produce the R-T-B-M-C alloy powder including the lubricant having an average particle size of $X_{50}$=5.0 μm.

The R-T-B-M-C sintered blocks are made from the R-T-B-M-C alloy powder including the lubricant by using the same process as set forth in Example 1. In this example, when making the R-T-B-M-C sintered blocks, the R-T-B-M-C alloy powder including the lubricant in the mold 48 is at the filling density of 3.2 g/cm$^3$. The predetermined pressure used to compress the R-T-B-M-C alloy powder including the lubricant in the mold 48 is set at 2.0 MPa. The R-T-B-M-C alloy powder including the lubricant in the mold 48 is also subjected to an orientating process under a magnetic field having a magnetic field strength of 6 T. Next, the R-T-B-M-C alloy powder including the lubricant is sintered at a temperature of 1060° C. for a period of 5 hours and heat treated at a temperature of 500° C. for a period of 3 hours to produce a sintered block. R-T-B-M-C sintered blocks 1 through 4 are made using the method described above. Compositions of the sintered blocks 1 through 4 are shown below in Table 3.

TABLE 3

Compositions of the R-T-B-M-C Sintered Blocks (wt. %)

| | Nd | Pr | Dy | Co | B | Al | Cu | Ga | C | Fe |
|---|---|---|---|---|---|---|---|---|---|---|
| Sintered Block Composition 1 | 21.54 | 6.31 | 4.48 | 0.87 | 0.96 | 0.10 | 0.09 | 0.09 | 0.04 | Bal. |
| Sintered Block Composition 2 | 21.57 | 6.29 | 4.45 | 0.88 | 0.95 | 0.11 | 0.08 | 0.09 | 0.13 | Bal. |
| Sintered Block Composition 3 | 21.58 | 6.28 | 4.49 | 0.87 | 0.96 | 0.13 | 0.11 | 0.08 | 0.02 | Bal. |
| Sintered Block Composition 4 | 21.61 | 6.29 | 4.47 | 0.89 | 0.96 | 0.13 | 0.10 | 0.09 | 0.18 | Bal. |

The sintered blocks 1 through 4 were made from the R-T-B-M-C alloy powders including the lubricant having Boric acid as the lubricant. When preparing the R-T-B-M-C alloy powders including the lubricant, various amounts of Boric Acid were mixed with the R-T-B-M-C alloy powder to produce the sintered blocks 1 through 4. Physical properties of sintered blocks 1 through 4 are shown below in Table 4.

TABLE 4

Physical Properties of the Sintered Blocks 1 through 4 Listed in Table 3

| | Amount of lubrication (wt. %) | Br (T) | Hcb (kA/m) | Hcj (kA/m) | BHm (kJ/m) | Hk/Hcj |
|---|---|---|---|---|---|---|
| Sintered Block Composition 1 | 0.08 | 1.284 | 983 | 1783 | 313 | 0.97 |
| Sintered Block Composition 2 | 2 | 1.288 | 984 | 1775 | 312 | 0.98 |
| Sintered Block Composition 3 | 0.03 | 1.232 | 892 | 1653 | 259 | 0.91 |
| Sintered Block Composition 4 | 2.5 | 1.285 | 897 | 1648 | 258 | 0.88 |

As indicate in Table 4 above, the amount of boric acid added to the R-T-B-M-C alloy powder used to make Sintered Block Compositions 1, 2, 3 and 4 are 0.08 wt. %, 2.0 wt. %, 0.03 wt. % and 2.5 wt. %, respectively. Compared to the physical properties of the Sintered Block Composition 3 listed in Table 4, Sintered Block Compositions 1, 2 and 4 all had an approximately 4.3% increase in their residual flux density (Br). Compared to the physical properties of the Sintered Block composition 4 listed in Table 4, coercivity ($H_{cj}$) of Sintered Block Compositions 1 and 2 increased by 7.6% and 5.5%, respectively.

Example 3

The R-T-B-M-C alloy powder including the lubricant used in this example is prepared in the same manner as the R-T-B-M-C alloy powder including the lubricant set forth in Example 1. In this example, Oleic acid is used as the lubricant. Specifically, 0.1 wt. % of the Oleic acid is mixed with the R-T-B-M-C alloy powder to produce the R-T-B-M-C alloy powder including the lubricant having an average particle size of $X_{50}$=5.0 μm.

The R-T-B-M-C sintered blocks are made from the R-T-B-M-C alloy powder including the lubricant by using the same process as set forth in Example 1. In this example, when making the R-T-B-M-C sintered blocks, the R-T-B-M-C alloy powder including the lubricant in the mold 48 is at a filling density of 3.2 g/cm$^3$. The predetermined pressure used to compress the R-T-B-M-C alloy powder including the lubricant in the mold 48 is set at 2.0 MPa. The R-T-B-M-C alloy powder including the lubricant in the mold 48 is also subjected to an orientating process under a magnetic field. Next, the R-T-B-M-C alloy powder including the lubricant is sintered at a temperature of 1060° C. for a period of 5 hours and heat treated at a temperature of 500° C. for a period of 3 hours to produce a sintered block. R-T-B-M-C sintered blocks 1 through 3 are made using the method described above. Compositions of the sintered blocks 1 through 3 are shown below in Table 5.

TABLE 5

Compositions of the R-T-B-M-C Sintered Blocks (wt. %)

| | Nd | Pr | Dy | Co | B | Al | Cu | Ga | C | Fe |
|---|---|---|---|---|---|---|---|---|---|---|
| Sintered Block Composition 1 | 21.56 | 6.31 | 4.48 | 0.84 | 0.96 | 0.10 | 0.09 | 0.09 | 0.06 | Bal |
| Sintered Block Composition 2 | 21.58 | 6.29 | 4.45 | 0.86 | 0.96 | 0.09 | 0.09 | 0.09 | 0.06 | Bal |
| Sintered Block Composition 3 | 21.55 | 6.28 | 4.48 | 0.88 | 0.96 | 0.12 | 0.10 | 0.09 | 0.06 | Bal |

The sintered blocks 1 through 3 were made from the R-T-B-M-C alloy powders including the lubricant having Oleic acid as the lubricant. When making Sintered Blocks 1, 2 and 3, the R-T-B-M-C alloy powders including the lubricant in the mold 48 for each of the Sintered Blocks were subjected to a magnetic field having different magnetic field strength. Physical properties of Sintered Blocks 1 through 3 are shown below in Table 6.

TABLE 6

Physical Properties of the Sintered Blocks 1 through 3 Listed in Table 5

| | Magnetic field (T) | Br (T) | Hcb (kA/m) | Hcj (kA/m) | BHm (kJ/m$^3$) | Hk/Hcj |
|---|---|---|---|---|---|---|
| Sintered Block Composition 1 | 6 | 1.289 | 988 | 1745 | 315 | 0.98 |
| Sintered Block Composition 2 | 4 | 1.287 | 977 | 1749 | 309 | 0.98 |
| Sintered Block Composition 3 | 3 | 1.252 | 877 | 1813 | 284 | 0.88 |

As indicated in Table 6 above, when the magnetic field strength of the orientation process exceeds 3 T, there is an increase in the sintered block's remanence (Br), of the sintered block. Specifically, when compared to the Sintered Block Composition 3 which was magnetized under the orientation process having a magnetic strength of 3 T, the remanence (Br) for Sintered Block Composition 1 (magnetized under the orientation process having a magnetic strength of 6 T) and Sintered Block Composition 2 (magnetized under the orientation process having a magnetic strength of 4 T) increased by 2.9% and 2.7%, respectively.

Example 4

The R-T-B-M-C alloy powder including the lubricant used in this example is prepared in the same manner as the R-T-B-M-C alloy powder including the lubricant set forth in Example 1. In this example, the R-T-B-M-C alloy powder including the lubricant is prepared by using R-T-B-M-C alloy powders having different average particle sizes. In addition, in this example, instead of zinc stearate, lithium stearate is used as the lubricant. Specifically, 0.06 wt. % of the lithium stearate is mixed with the R-T-B-M-C alloy powder to produce the R-T-B-M-C alloy powder including the lubricant.

The R-T-B-M-C sintered blocks are made from the R-T-B-M-C alloy powder including the lubricant by using the same process as set forth in Example 1. In this example, when making the R-T-B-M-C sintered blocks, the R-T-B-M-C alloy powder including the lubricant in the mold 48 is at a filling density of 3.2 g/cm$^3$. The predetermined pressure used to compress the R-T-B-M-C alloy powder including the lubricant in the mold 48 is set at 2.0 MPa. The R-T-B-M-C alloy powder including the lubricant in the mold 48 is also subjected to an orientating process under a magnetic field having a magnetic field strength of 6 T. Next, the R-T-B-M-C alloy powder including the lubricant is sintered at a temperature of 1060° C. for a period of 5 hours and heat treated at a temperature of 500° C. for a period of 3 hours to produce a sintered block. R-T-B-M-C sintered blocks 1 through 4 are made using the method described above. Compositions of the sintered blocks 1 through 4 are shown below in Table 7.

TABLE 7

Compositions of the R-T-B-M-C Sintered Blocks (wt. %)

| | Nd | Pr | Dy | Co | B | Al | Cu | Ga | C | Fe |
|---|---|---|---|---|---|---|---|---|---|---|
| Sintered Block Composition 1 | 21.53 | 6.24 | 4.41 | 0.88 | 0.95 | 0.1 | 0.09 | 0.10 | 0.06 | Bal |
| Sintered Block Composition 2 | 21.56 | 6.23 | 4.43 | 0.86 | 0.95 | 0.1 | 0.08 | 0.09 | 0.06 | Bal |
| Sintered Block Composition 3 | 21.52 | 6.25 | 4.46 | 0.83 | 0.94 | 0.09 | 0.08 | 0.09 | 0.06 | Bal |
| Sintered Block Composition 4 | 21.57 | 6.25 | 4.42 | 0.82 | 0.95 | 0.12 | 0.10 | 0.09 | 0.06 | Bal |

The sintered blocks 1 through 4 listed in Table 7 were made from the R-T-B-M-C alloy powders including the lubricant having lithium stearate as the lubricant. When preparing the Sintered Blocks 1 through 4, the R-T-B-M-C alloy powders having various average particle sizes were used. Physical properties of Sintered Blocks 1 through 4 are shown below in Table 8.

TABLE 8

Physical Properties of the Sintered Blocks 1 through 4 Listed in Table 7

| | Average particle size (μm) | Br (T) | Hcb (kA/m) | Hcj (kA/m) | (BH) m (kJ/m$^3$) | Hk/Hcj |
|---|---|---|---|---|---|---|
| Sintered Block Composition 1 | 2 | 1.288 | 984 | 1850 | 314 | 0.96 |
| Sintered Block Composition 2 | 5 | 1.296 | 990 | 1737 | 318 | 0.96 |
| Sintered Block Composition 3 | 7 | 1.285 | 971 | 1681 | 318 | 0.93 |

TABLE 8-continued

Physical Properties of the Sintered Blocks 1 through 4 Listed in Table 7

| | Average particle size (μm) | Br (T) | Hcb (kA/m) | Hcj (kA/m) | (BH) m (kJ/m$^3$) | Hk/Hcj |
|---|---|---|---|---|---|---|
| Sintered Block Composition 4 | 12 | 1.265 | 905 | 1578 | 262 | 0.90 |

As indicated in Table 8 above, compared to Sintered Block Composition made from the R-T-B-M-C alloy powder having an average particle size of 12 nm, Sintered Block Compositions 1, 2 and 3 all have a higher remanence (Br), than Composition 4 by 1.8%, 2.4% and 1.7%, respectively.

Example 5

The R-T-B-M-C alloy powder including the lubricant used in this example is prepared in the same manner as the R-T-B-M-C alloy powder including the lubricant set forth in Example 1. In this example, methyl acetate is used as the lubricant. Specifically, 0.15 wt. % of the methyl acetate is mixed with the R-T-B-M-C alloy powder to produce the R-T-B-M-C alloy powder including the lubricant having an average particle size of $X_{50}$=5.0 μm.

The R-T-B-M-C sintered blocks are made from the R-T-B-M-C alloy powder including the lubricant by using the same process as set forth in Example 1. In this example, when making the R-T-B-M-C sintered blocks, the R-T-B-M-C alloy powder including the lubricant in the mold 48 is at different filling densities. The predetermined pressure used to compress the R-T-B-M-C alloy powder including the lubricant in the mold 48 is set at 2.0 MPa. The R-T-B-M-C alloy powder including the lubricant in the mold 48 is also subjected to an orientating process under a magnetic field having a magnetic field strength of 6 T. Next, the R-T-B-M-C alloy powder including the lubricant is sintered at a temperature of 1060° C. for a period of 5 hours and heat treated at a temperature of 500° C. for a period of 3 hours to produce a sintered block. R-T-B-M-C sintered blocks 1 through 4 are made using the method described above. Compositions of the sintered blocks 1 through 4 are shown below in Table 9.

TABLE 9

Compositions of the R-T-B-M-C Sintered Blocks (wt. %)

| | Nd | Pr | Dy | Co | B | Al | Cu | Ga | C | Fe |
|---|---|---|---|---|---|---|---|---|---|---|
| Sintered Block Composition 1 | 21.55 | 6.22 | 4.43 | 0.85 | 0.99 | 0.13 | 0.09 | 0.09 | 0.05 | Bal |
| Sintered Block Composition 2 | 21.51 | 6.27 | 4.41 | 0.88 | 0.95 | 0.12 | 0.10 | 0.09 | 0.05 | Bal |
| Sintered Block Composition 3 | 21.57 | 6.29 | 4.49 | 0.84 | 0.93 | 0.11 | 0.09 | 0.09 | 0.05 | Bal |
| Sintered Block Composition 4 | 21.54 | 6.23 | 4.43 | 0.89 | 0.93 | 0.12 | 0.08 | 0.09 | 0.05 | Bal |

The sintered blocks 1 through 4 listed in Table 9 were made using the R-T-B-M-C alloy powders including the lubricant of methyl acetate. When preparing the Sintered Blocks 1 through 4, the R-T-B-M-C alloy powders including the lubricant having various filling densities were used. Physical properties of Sintered Blocks 1 through 4 are shown below in Table 8.

TABLE 10

Physical Properties of the Sintered Blocks 1 through 4 Listed in Table 9

| | Filling density (g/cm$^3$) | Br (T) | Hcb (kA/m) | Hcj (kA/m) | (BH)m (kJ/m$^3$) | Hk/Hcj |
|---|---|---|---|---|---|---|
| Sintered Block Composition 1 | 3.0 | 1.286 | 985 | 1732 | 314 | 0.97 |
| Sintered Block Composition 2 | 3.6 | 1.285 | 984 | 1788 | 313 | 0.97 |
| Sintered Block Composition 3 | 2 5 | Cracks were found on the surface of the Sintered Blocks. | | | | |
| Sintered Block Composition 4 | 4.0 | 1.254 | 868 | 1565 | 257 | 0.87 |

As indicated in Table 10 above, Sintered Block Compositions 1 and 2 were made from the R-T-B-M-C alloy powders including the lubricant having filling densities of 3.0 g/cm$^3$ and 3.6 g/cm$^3$, respectively. Compared to the Sintered Block Composition 4, made from the R-T-B-M-C alloy powders including the lubricant having filling density of 4.0 g/cm$^3$. Sintered Block Compositions 1 and 2 have a higher remanence (Br) than Sintered Block Composition 4 by 7%. For the Sintered Block Composition 3, because the filling density of the R-T-B-M-C alloy powders including the lubricant used was too low, after the sintering process, cracks were found on the surface of Sintered Block Composition 3 and, therefore, its physical properties including the remanence (Br) was not measured.

Example 6

The R-T-B-M-C alloy powder including the lubricant used in this example is prepared in the same manner as the R-T-B-M-C alloy powder including the lubricant set forth in Example 1. In this example, Oleic Acid is used as the lubricant. Specifically, 0.1 wt. % of the Oleic Acid is mixed with the R-T-B-M-C alloy powder to produce the R-T-B-M-C alloy powder including the lubricant. In addition, the R-T-B-M-C alloy powder having an average particle size of $X_{50}$=3.0 μm is used to prepare the R-T-B-M-C alloy powder including the lubricant for this example.

The R-T-B-M-C sintered blocks are made from the R-T-B-M-C alloy powder including the lubricant by using the same process as set forth in Example 1. In this example, when preparing the R-T-B-M-C sintered blocks, the predetermined pressure used to compress the R-T-B-M-C alloy powder including the lubricant in the mold 48 is set at 1.0 MPa. The R-T-B-M-C alloy powder including the lubricant in the mold 48 is also subjected to an orientating process under a magnetic field having a magnetic field strength of 4.0 T. Next, the R-T-B-M-C alloy powder including the lubricant is sintered at a temperature of 1045° C. for a period of 5 hours and heat treated at a temperature of 500° C. for a period of 3 hours to produce a sintered block. Compositions of the sintered block are shown below in Table 11.

TABLE 11

Compositions of the R-T-B-M-C Sintered Blocks (wt. %)

| | Nd | B | Cu | C | Fe |
|---|---|---|---|---|---|
| Sintered Block Composition 1 | 29.00 | 0.88 | 0.05 | 0.04 | Bal |

The Sintered Block Composition 1 listed in Table 11 is made by using the R-T-B-M-C alloy powders including the lubricant of Oleic Acid. The physical properties of the Sintered Composition 1 are shown below in Table 12.

TABLE 12

Physical Properties of the Sintered Block 1 Listed in Table 11

| | Br (T) | Hcb (kA/m) | Hcj (kA/m) | BHm (kJ/m$^3$) | Hk/Hcj |
|---|---|---|---|---|---|
| Sintered Block Composition 1 | 1.465 | 945 | 968 | 392 | 0.96 |

Example 7

The R-T-B-M-C alloy powder including the lubricant used in this example is prepared in the same manner as the R-T-B-M-C alloy powder including the lubricant set forth in Example 1. In this example, a mixture of methyl acetate and caprylic acid methyl ester is used as the lubricant. Specifically, the lubricant used in the present example is prepared by mixing 1.0 wt. % of methyl acetate with 0.8 wt. % of caprylic acid methyl ester. In addition, the R-T-B-M-C alloy powder having an average particle size of $X_{50}$=6.0 μm is used to prepare the R-T-B-M-C alloy powder including the lubricant for this example.

The R-T-B-M-C sintered blocks are made from the R-T-B-M-C alloy powder including the lubricant by using the same process as set forth in Example 1. In this example, when making the R-T-B-M-C sintered blocks, the predetermined pressure used to compress the R-T-B-M-C alloy powder including the lubricant in the mold 48 is set at 1.5 MPa. The R-T-B-M-C alloy powder including the lubricant in the mold 48 is also subjected to an orientating process under a magnetic field having a magnetic field strength of 5.0 T. Next, the R-T-B-M-C alloy powder including the lubricant is sintered at a temperature of 1073° C. for a period of 5.5 hours and heat treated at a temperature of 480° C. for a period of 3 hours to produce a sintered block. Compositions of the sintered block made in this example are shown below in Table 13.

TABLE 13

Compositions of the R-T-B-M-C Sintered Blocks (wt. %)

| | Nd | Pr | Dy | Co | B | Al | Cu | Ga | C | Fe |
|---|---|---|---|---|---|---|---|---|---|---|
| Sintered Block Composition 1 | 19.8 | 5.1 | 9.87 | 2.99 | 1.13 | 0.98 | 0.14 | .028 | .014 | Bal |

The Sintered Composition 1 listed in Table 13 is made by using the R-T-B-M-C alloy powders including the lubricant of a mixture between methyl acetate and caprylic acid methyl ester. The physical properties of the Sintered Composition 1 are shown below in Table 14.

TABLE 14

Physical Properties of the Sintered Block 1 Listed in Table 13

| | Br (T) | Hcb (kA/m) | Hcj (kA/m) | BHm (kJ/m$^3$) | Hk/Hcj |
|---|---|---|---|---|---|
| Sintered Block Composition 1 | 0.935 | 738 | 3213 | 171 | 0.95 |

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for preparing the R-T-B-M-C sintered rare earth magnet from an R-T-B-M-C alloy powder using a mold, said method comprising the steps of;

mixing the R-T-B-M-C alloy powder having a predetermined particle size with a lubricant under an inert gas environment to produce an R-T-B-M-C alloy powder including the lubricant, wherein R is at least one rare earth element selected from Y and Sc, a weight content of R is at least 25 weight percent (wt. %) and not greater than 40 wt. %, T is at least one element selected from Fe and Co, a weight content of T is at least 60 wt. % and not greater than 74 wt. %, M is at least one element selected from Ti, Ni, Nb, Al, V, Mn, Sn, Ca, Mg, Pb, Sb, Zn, Si, Zr, Cr, Cu, Ga, Mo, W and Ta, a weight content of M is not greater than 2 wt. %, B is boron, a weight content of B is at least 0.8 wt. % and not greater than 1.2 wt. %, C is carbon, a weight content of C is at least 0.03 wt. % and not greater than 0.15 wt. %, a weight content of the lubricant is at least 0.05 wt. % and not greater than 2 wt. %, filling the mold with the R-T-B-M-C alloy powder including the lubricant and oscillating the mold so the R-T-B-M-C alloy powder including the lubricant achieves a filling density of between 2.8 g/cm$^3$ and 3.8 g/cm$^3$ under the inert gas environment, engaging a cover on the mold to compress the R-T-B-M-C alloy powder including the lubricant in the mold under a predetermined pressure between 0.2 MPa and 2 MPa, orienting the R-T-B-M-C alloy powder including the lubricant in the mold by applying a magnetic field to the R-T-B-M-C alloy powder including the lubricant under the inert gas environment to form a compact, sintering the compact in the mold, subjecting the sintered compact to a heat treatment.

2. The method for preparing the R-T-B-M-C sintered rare earth magnet as set forth in claim 1 wherein the lubricant is at least one or a mixture selected from a salt of stearic acid, oleic acid, boric acid, methyl acetate and caprylic acid methyl ester.

3. The method for preparing the R-T-B-M-C sintered rare earth magnet as set forth in claim 1 wherein the magnetic field used in said orienting step is a DC pulsed magnetic field having a magnetic field strength of at least 3.5T.

4. The method for preparing the R-T-B-M-C sintered rare earth magnet as set forth in claim 1 wherein the predetermined particle size of the R-T-B-M-C has an average particle size of less than 8 μm.

* * * * *